US006755627B2

(12) United States Patent
Chang

(10) Patent No.: US 6,755,627 B2
(45) Date of Patent: Jun. 29, 2004

(54) LINEAR COMPRESSOR

(75) Inventor: Phil-Soo Chang, Osan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/200,740

(22) Filed: Jul. 24, 2002

(65) Prior Publication Data

US 2003/0147759 A1 Aug. 7, 2003

(30) Foreign Application Priority Data

Feb. 1, 2002 (KR) ..... 2002-5865

(51) Int. Cl.[7] ..... F04B 17/04; F04B 35/04

(52) U.S. Cl. ..... 417/417

(58) Field of Search ..... 417/417, 415, 417/416, 545, 550, 552; 92/110, 113, 114, 130 R; 310/15

(56) References Cited

U.S. PATENT DOCUMENTS 5,275,542 A * 1/1994 Terauchi ..... 417/417
5,907,201 A * 5/1999 Hiterer et al. ..... 310/30
6,077,054 A 6/2000 Lee et al. ..... 417/417
6,084,320 A * 7/2000 Morita et al. ..... 310/12
6,328,544 B1 * 12/2001 Kawahara et al. ..... 417/416
6,540,485 B2 * 4/2003 Nara et al. ..... 417/44.1

FOREIGN PATENT DOCUMENTS

JP 11-324912 * 11/1999

* cited by examiner

*Primary Examiner*—Justine R. Yu
*Assistant Examiner*—Han L Liu
(74) *Attorney, Agent, or Firm*—Staas & Halsey LLP

(57) ABSTRACT

A linear compressor provided with an anti-collision device to prevent a piston from coming into collision with a cylinder head and/or a suction valve even when the piston moves past an upper dead center position thereof. The anti-collision device prevents the piston of the compressor from being brought into collision with the cylinder head and/or the suction valve even when the piston moves past the upper dead center position during an operation of the compressor. Therefore, it is possible to prevent the piston and the cylinder head having the suction valve, from breaking. The linear compressor having the anti-collision device almost completely prevents a collision of the piston with the suction valve or the cylinder head during an operation, thus minimizing a gap between the piston and the cylinder head when the piston reaches the upper dead center position thereof.

19 Claims, 9 Drawing Sheets

LINEAR COMPRESSOR

CROSS-REFERENCE TO RELATED APPLICATIONS

This application claims the benefit of Korean Application No. 2002-5865, filed Feb. 1, 2002, in the Korean Patent Office, the disclosure of which is incorporated herein by reference.

BACKGROUND OF THE INVENTION

1. Field of the Invention

The present invention relates, in general, to linear compressors and, more particularly, to a linear compressor provided with an anti-collision device for preventing a piston from excessively moving past an upper dead center position of the linear compressor inside a cylinder to collide against the cylinder head having a suction valve.

2. Description of the Related Art

As well known to those skilled in the art, a compressor is a machine that sucks and compresses gas refrigerant in a refrigerating system or an air conditioning system, such as a refrigerator or an air conditioner, by performing a refrigeration cycle. Such compressors have been typically classified into three types: reciprocating compressors, rotary compressors and linear compressors. In the linear compressors, a linear motor is used as a drive unit linearly reciprocating a piston to compress gas refrigerant and is low in energy loss for the drive unit, thus being high in energy efficiency in comparison with the other types of compressors. FIG. 1 is a view, showing the construction of a conventional linear compressor.

As shown in FIG. 1, the conventional linear compressor comprises a drive unit 2 and a compressing unit 3, which are housed in a hermetic casing 1. The drive unit 2 generates drive power when supplied by electricity, while the compressing unit 3 sucks gas refrigerant and compresses the gas refrigerant using the drive power transmitted from the drive unit 2.

The compressing unit 3 comprises a cylinder block 3*a* having a cylinder 3*b*, with a cylinder head 3*c* assembled with a lower end of the cylinder block 3*a* and provided with a suction valve 8*a* and an exhaust valve 8*b* guiding inlet and outlet gas refrigerant. A piston 3*d* is movably received in the cylinder 3*b* such that the piston 3*d* linearly reciprocates in the cylinder 3*b* using the drive power transmitted from the drive unit 2.

The drive unit 2, which is a linear motor, comprises a cylindrical inside stator 4 fitted over the cylinder 3*b*, and a cylindrical outer stator 5 which is arranged such that the cylindrical outside stator 5 surrounds the cylindrical inside stator 4 with an annular gap defined between the two stators 4 and 5. A magnet 6 is positioned in the gap formed between the two stators 4 and 5 such that the magnet 6 vertically reciprocates in the gap.

The cylindrical outside stator 5 is fabricated by closely layering a plurality of steel sheets 5*a* in a radial direction, thus forming a cylindrical shape. A coil 5*b* is wound in the cylindrical outside stator 5, and so the cylindrical outside stator 5 generates a magnetic flux when an alternating current AC is applied to the coil 5*b* of the cylindrical outside stator 5. The lower end of the cylindrical outside stator 5 is seated on a first support frame 3*e*, which extends outward in a radial direction from a lower end of the cylinder block 3*a*. An upper end of the cylindrical outside stator 5 is supported by a second support frame 3*f*, which is assembled with the first support frame 3*e* using a plurality of bolts 9.

The cylindrical inner stator 4 is fabricated by regularly arranging a plurality of steel sheets 4*b* in a radial direction around a cylindrical holder 4*a*. This cylindrical inside stator 4 is positioned outside the cylinder 3*b*, and forms a complete electromagnetic circuit of the linear motor in combination with the cylindrical outside stator 5 having the coil 5*b*.

The magnet 6 is arranged such that the magnet 6 vertically reciprocates in the gap between the two stators 4 and 5, and is connected to the piston 3*d*. Therefore, the piston 3*d* linearly reciprocates in the cylinder 3*b* at the same time as a linear reciprocating action of the magnet 6. A resonant spring 7, as shown in FIG. 1, is used to enhance a reciprocating force of the piston 3*d*.

When the alternating current AC is applied to the coil 5*b* of the cylindrical outside stator 5, the coil 5*b* generates a magnetic flux. This magnetic flux of the coil 5*b* cooperates with the magnetic field of the magnet 6, thus allowing the magnet 6 and the piston 3*d* to reciprocate in a vertical direction at the same time.

When the piston 3*d* moves from a stop position to a lower dead center position, as shown by the arrow "B" of FIG. 1, during a reciprocating action of the piston 3*d*, the suction valve 8*a* is opened, while the exhaust valve 8*b* is closed. Gas refrigerant is sucked from a suction chamber into the cylinder 3*b*. When the piston 3*d* moves to the upper dead center position, as shown by the arrow "A" of FIG. 1, the suction valve 8*a* is closed, while the exhaust valve 8*b* is opened to discharge the compressed gas refrigerant from the hermetic casing 1.

In a conventional linear compressor, a natural frequency of the resonant spring 7, according to a mass of both the piston 3*d* and the magnet 6, is set to be substantially equal to a frequency of the alternating current AC applied to the coil 5*b* of the cylindrical outside stator 5, and the drive unit 2 can therefore generate high drive power by resonance of the piston 3*d*, magnet 6 and resonant spring 7. An amplitude of both the reciprocating piston 3*d* and the magnet 6 is regulated by controlling an applied voltage. To allow the piston 3*d* to stably reciprocate with a predetermined amplitude, a separate control unit (not shown) is provided, which is capable of stably controlling the amplitude of the piston 3*d*.

In the conventional linear compressor, a volumetric efficiency of the compressor varies in accordance with a clearance volume determined by a minimum gap between the cylinder head 3*c* and the upper dead center position of the piston 3*d*. Accordingly, higher volumetric efficiency of the linear compressor can be obtained as the minimum gap distance is reduced. Therefore, when high volumetric efficiency of the linear compressor is desired, the clearance volume should be reduced as much as possible by controlling the amplitude of the piston 3*d* such that the piston 3*d* can closely approach the cylinder head 3*c* and the suction valve 8*a* during an operation of the linear compressor.

However, during a linear reciprocating action of the piston 3*d* in the cylinder 3*b* of the conventional linear compressor, behavior of the piston 3*d* may unexpectedly become unstable, thus abruptly and rapidly increasing the amplitude of the piston 3*d* due to unexpected internal or external causes, such as unexpected rapid variation in the applied voltage or unexpected rapid variation in a pressure of a refrigeration cycle.

When the amplitude of the piston 3*d* rapidly increases as described above, the end of the piston 3*d* may collide with the suction valve 8*a* and/or the cylinder head 3*c*, thus generating operational noise, as well as causing serious damage or breakage of the cylinder head 3*c*, the suction valve 8*a*, and/or the piston 3*d*.

SUMMARY OF THE INVENTION

Accordingly, the present invention has been made keeping in mind the above problems occurring in the related art, and an object of the present invention is to provide a linear compressor, which is provided with an anti-collision device for preventing a movement of a piston past an upper dead center position of the piston in a cylinder, thereby preventing the piston from colliding with a suction valve and/or a cylinder head, and attenuates impacts resulting from an excessive movement of the piston.

Additional objects and advantages of the invention will be set forth in part in the description which follows and, in part, will be obvious from the description, or may be learned by practice of the invention.

To accomplish the above and other objects, a linear compressor is provided, which comprises a cylinder block provided on a upper surface thereof with a cylinder receiving a piston in the cylinder while allowing the piston to linearly reciprocate in the cylinder, a cylinder head assembled with a lower surface of the cylinder block and used to guide inlet and outlet refrigerant, a movable member connected to the piston and provided with a magnet arranged around the cylinder, and a drive unit reciprocating both the piston and the movable member. The linear compressor further comprises an anti-collision device set between the upper surface of the cylinder block and an end of the movable member, and used to prevent the piston from moving past an upper dead center position of the piston and thereby preventing the piston from colliding with the cylinder head.

The anti-collision device comprises a stopper including a mounting part having a ring-shaped appearance, and mounted to the upper surface of the cylinder block; and an elastic support part integrally extending from an edge of the mounting part while being inclined upward and outward at an angle of inclination such that the elastic support part is spaced apart from the upper surface of the cylinder block with a predetermined gap, the elastic support part colliding with an end of the movable member just before the piston would otherwise collide against the cylinder head.

In the linear compressor, the drive unit comprises a stator mounted to the upper surface of the cylinder block using mounting bolts such that the stator is arranged around the cylinder, and the mounting part of the stopper is arranged between the upper surface of the cylinder block and the stator of the drive unit, and is mounted along with the stator to the upper surface of the cylinder block using the mounting bolts.

The anti-collision device may further comprise a damping member provided at the predetermined gap between the elastic support part of the stopper and the upper surface of the cylinder block.

The damping member may be made of ring-shaped rubber having a predetermined thickness, and attached to the upper surface of the cylinder block.

Alternatively, the anti-collision device may further comprise a protrusion integrally formed on the upper surface of the cylinder block such that the protrusion is positioned under the elastic support part of the stopper while leaving a gap between the upper surface of the protrusion and the elastic support part of the stopper.

BRIEF DESCRIPTION OF THE DRAWINGS

These and other objects and advantages of the invention will become apparent and more readily appreciated from the following description of the preferred embodiments, taken in conjunction with the accompanying drawings of which:

FIGS. 6 and 7 are views showing an operation of the linear compressor of the embodiment of the present invention, in which FIG. 6 is a sectional view of the linear compressor, and FIG. 7 is a sectional view of a portion VII of FIG. 6, showing a first operating state of the anti-collision device of the embodiment of the present invention;

DETAILED DESCRIPTION OF THE INVENTION

Figure 1:
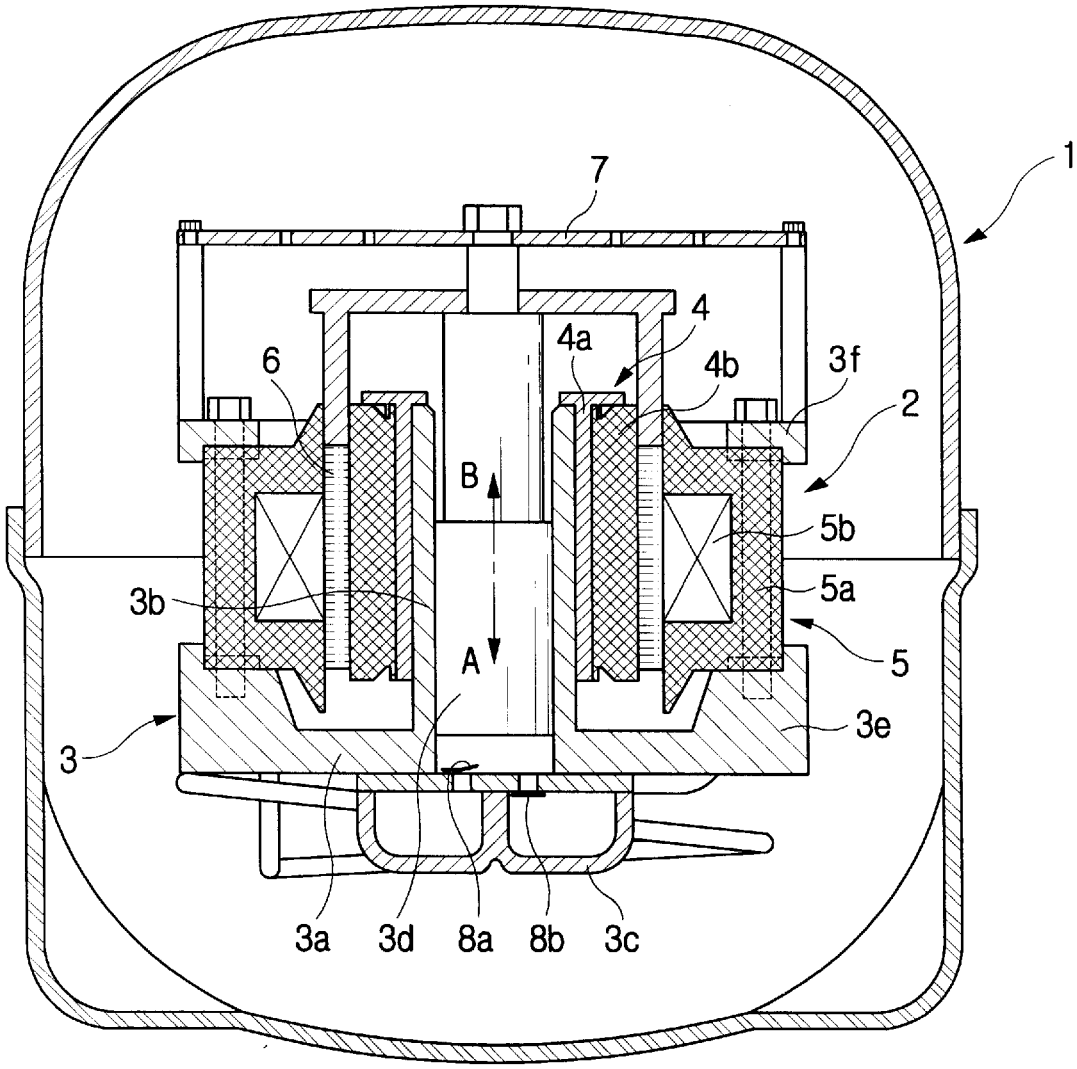
FIG. 1 (PRIOR ART)
FIG. 1 is a sectional view, showing the construction of a conventional linear compressor.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
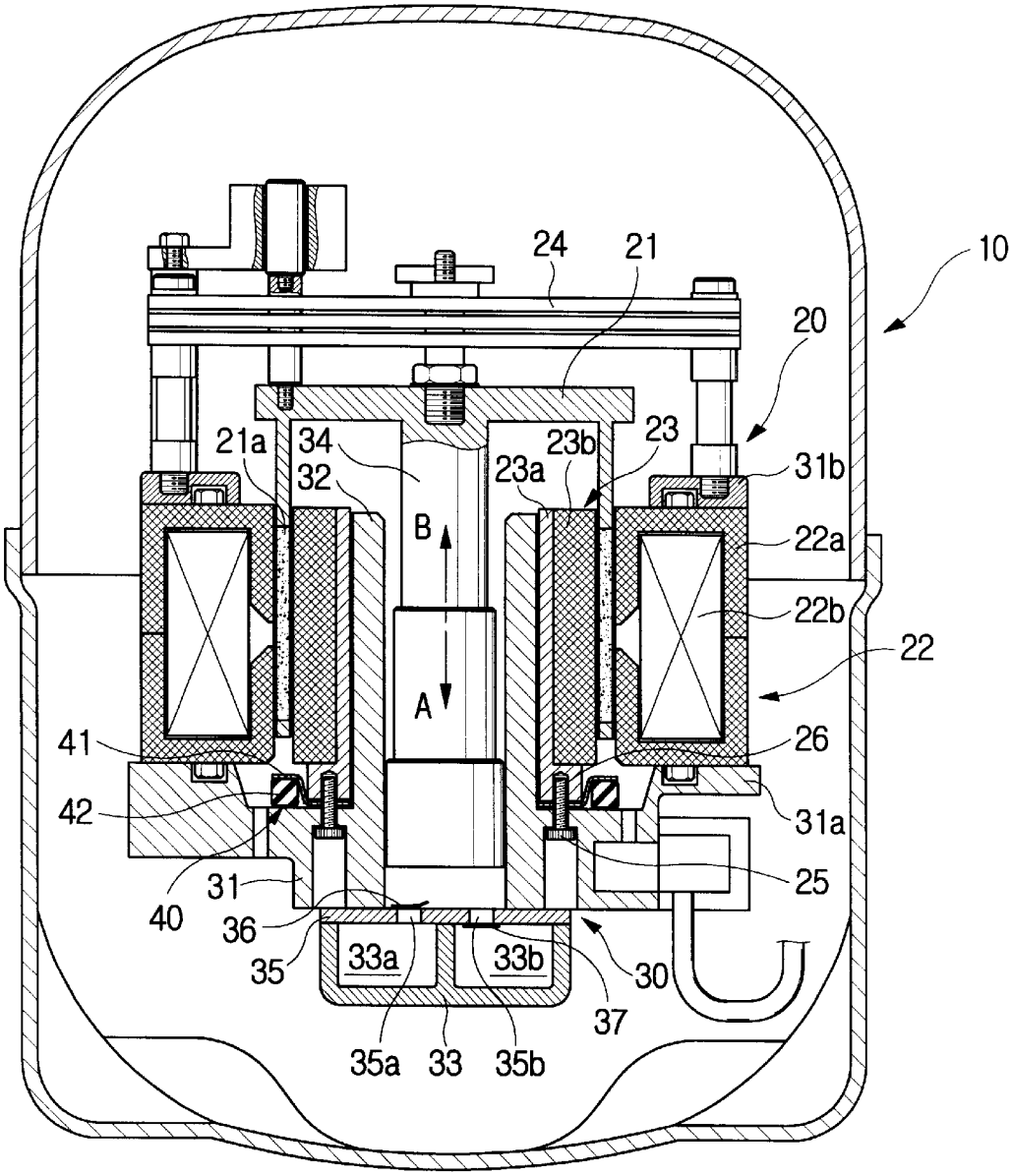
FIG. 2 is a sectional view, showing the internal construction of a linear compressor having an anti-collision device according to an embodiment of the present invention.

As shown in FIG. 2, the linear compressor according to an embodiment of the present invention comprises a compressing unit 30, a drive unit 20, and an anti-collision device 40, which are housed in a hermetic casing 10. The compressing unit 30 has a piston 34, and sucks, compresses and discharges gas refrigerant during an operation of the linear compressor. The drive unit 20 is activated by electric power applied from an external power source, and generates drive power actuating the compressing unit 30. The anti-collision device 40 is set in the compressor to prevent a movement of the piston 34 past an upper dead center position of the piston 34 in a direction as shown by the arrow "A" of FIG. 2, and prevent the piston 34 from colliding with another element of the compressing unit 30.

The compressing unit 30 is arranged in a lower portion of the interior space defined in the hermetic casing 10, and comprises a cylinder block 31, with a cylinder 32 vertically extending upward at the center of an upper surface of the cylinder block 31. A cylinder head 33 is assembled with a lower end of the cylinder block 31, and used to guide inlet and outlet gas refrigerant. The piston 34 is movably received in the cylinder 32 such that the piston 34 linearly reciprocates in the cylinder 32 using the drive power transmitted from the drive unit 20. The cylinder head 33 is provided with a suction chamber 33*a*, from which inlet gas refrigerant flows into the cylinder 32, and an exhaust chamber 33*b*, into which outlet gas refrigerant flows from the cylinder 32.

A valve plate 35, having a suction port 35*a* and an exhaust port 35*b*, is interposed between the cylinder block 31 and the cylinder head 33. The suction port 35*a* and the exhaust port 35*b* are provided with suction and exhaust valves 36 and 37, respectively, so that the two ports 35*a* and 35*b* are selectively opened or closed by the valves 36 and 37 in accordance with a linear reciprocating action of the piston 34 in the cylinder 32. Therefore, when the piston 34 moves from a stop position to a lower dead center position, as shown by the arrow B of FIG. 2, during the reciprocating action of the piston 34, the suction valve 36 is opened, while the exhaust valve 37 is closed. The gas refrigerant is thus sucked from the suction chamber 33*a* into the cylinder 32 through the open suction port 35*a*. When the piston 34 moves to the upper dead center position of the piston 34 as shown by the arrow "A" of FIG. 2, the suction valve 36 is closed, while the exhaust valve 37 is opened to discharge the compressed gas refrigerant from the cylinder 32 into the exhaust chamber 33*b* through the open exhaust port 35*b*.

The drive unit 20 comprises a linear motor, which includes a movable member 21, an outer stator 22, and an inner stator 23. The movable member 21 is arranged around the cylinder 32, and linearly moves along with the piston 34. The outer stator 22 is installed such that the outer stator 22 surrounds the movable member 21. The inner stator 23 is arranged around the cylinder 32 such that the inner stator 23 is spaced apart from the outer stator 22 to form a predetermined gap between the inner stator 23 and outer stator 22.

The movable member 21 is a cylindrical body, which is connected to the piston 34 at a center of the piston 34 and has a magnet 21*a* at a skirt part of the movable member 21. The magnet 21*a* is positioned in the predetermined gap formed between the two stators 22 and 23 such that the magnet 21*a* vertically reciprocates within the predetermined gap. The movable member 21 having the magnet 21*a* thus vertically reciprocates within the cylinder 32. A resonant spring 24 of a plate spring type is installed above the piston 34 or above the center of an upper end of the movable member 21 such that the resonant spring 24 is vibrated in a vertical direction. The resonant spring 24 enhances a reciprocating force of the piston 34.

The outer stator 22 is arranged around the inner stator 23 such that a predetermined gap is defined between the two stators 22 and 23. The outer stator 22 surrounds the magnet 21*a* set in the predetermined gap between the two stators 22 and 23. The outer stator 22 is fabricated by closely layering a plurality of steel sheets 22*a* in a radial direction, with a coil 22*b* circumferentially wound in an interior of the layered steel sheets 22*a* of the outer stator 22. The outer stator 22 thus generates a magnetic flux when an alternating current AC is applied to the coil 22*b* of the outer stator 22. To mount the outer stator 22 in the hermetic casing 10 of the linear compressor, an upper support frame 31*b* is bolted to a lower support frame part 31*a*, which integrally extends outward in a radial direction from the lower end of the cylinder block 31. That is, when the upper support frame 31*b* is bolted to the lower support frame part 31*a* of the cylinder block 31 after precisely arranging the outer stator 22 in the gap between the upper support frame 31*b* and the lower support frame part 31*a*, the outer stator 22 is firmly fixed to the upper portion of the cylinder block 31.

The inner stator 23 is concentrically arranged around the cylinder 32 such that the magnetic flux of the coil 22*b* of the outer stator 22 cooperates with the magnetic field of the magnet 21*a*. The inner stator 23 comprises a cylindrical holder 23*a*, which has a cylindrical shape suitable to be fit over the cylinder 32. A plurality of steel sheets 23*b* is arranged in a radial direction around the cylindrical holder 23*a*. The inner stator 23 is mounted to the upper surface of the cylinder block 31 using a plurality of mounting bolts 25. To receive the mounting bolts 25, a plurality of internally-threaded holes 26 are regularly formed at the lower surface of the cylindrical holder 23*a*. Therefore, when the mounting bolts 25 are tightened into the internally-threaded holes 26 of the cylindrical holder 23*a* at an outside of the lower surface of the cylinder block 31 after fitting the inner stator 23 over the cylinder 32, the inner stator 23 is firmly mounted to the upper surface of the cylinder block 31.

The anti-collision device 40 is set between the upper surface of the cylinder block 31 and an end of the movable member 21, and prevents a movement of the piston 34 past the upper dead center position of the piston 34, thus preventing the piston 34 from colliding with the suction valve 36 and/or the cylinder head 33 of the compressing unit 30. The anti-collision device 40 comprises a stopper 41, against which the end of the movable member 21 collides just before the piston 34 moves past the upper dead center position of the piston 34. The ant-collision device 40 also has a damping member 42, which attenuates impact caused by the collision of the movable member 21 against the stopper 41.

Figure 3:
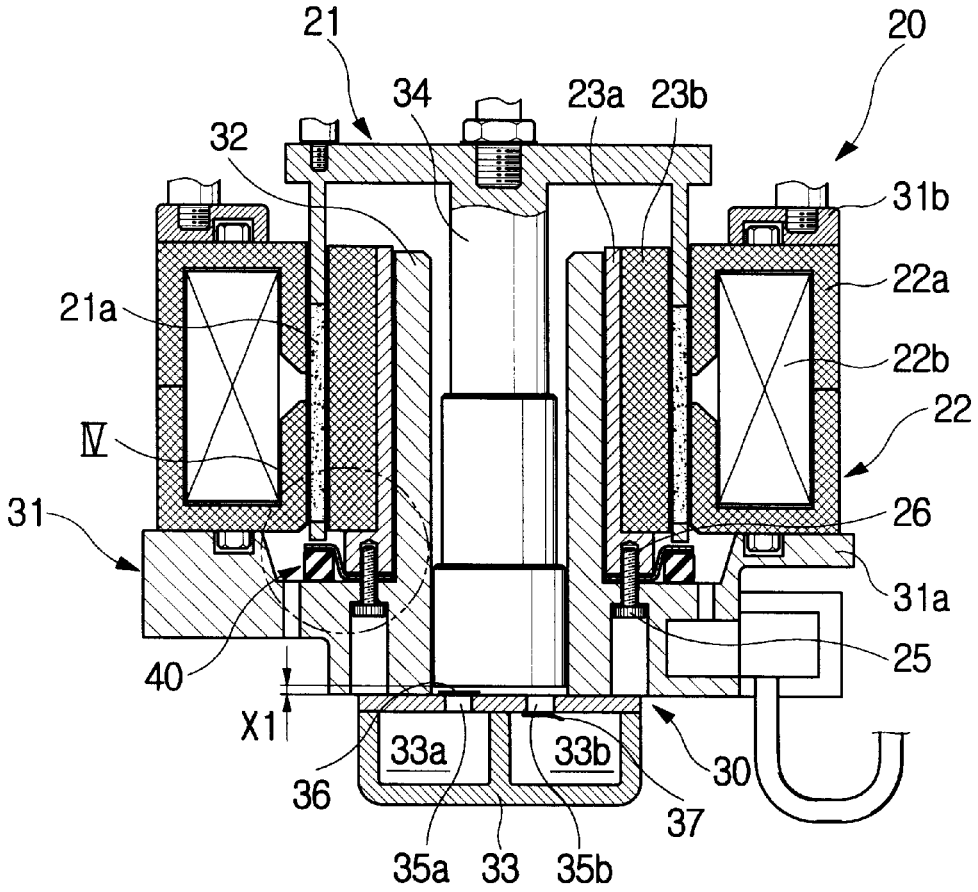
FIG. 3 is a sectional view, showing the structure to install the anti-collision device of FIG. 2 in the linear compressor.
Figure 4:
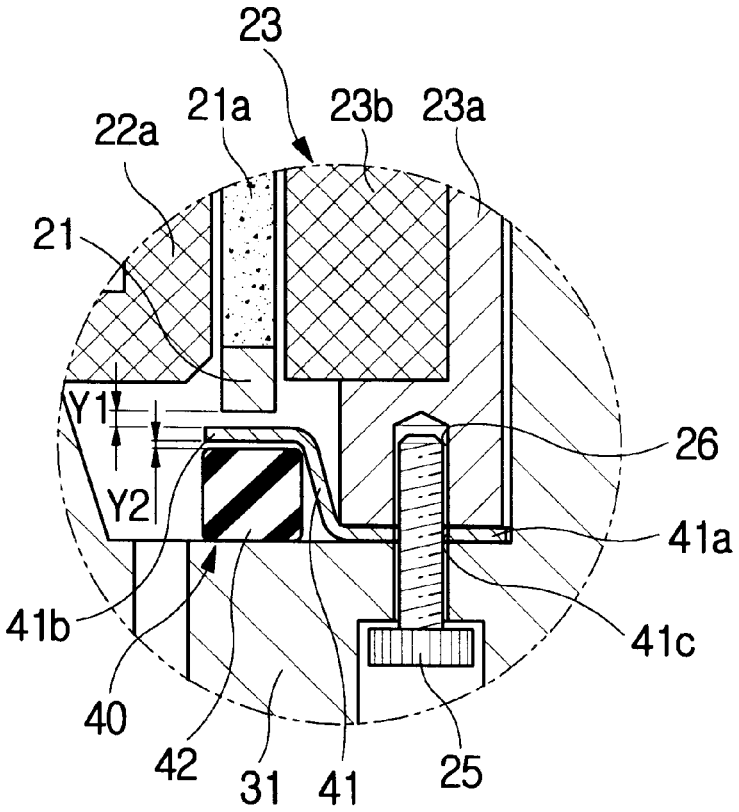
FIG. 4 is a sectional view of a portion IV of FIG. 3.
Figure 5:
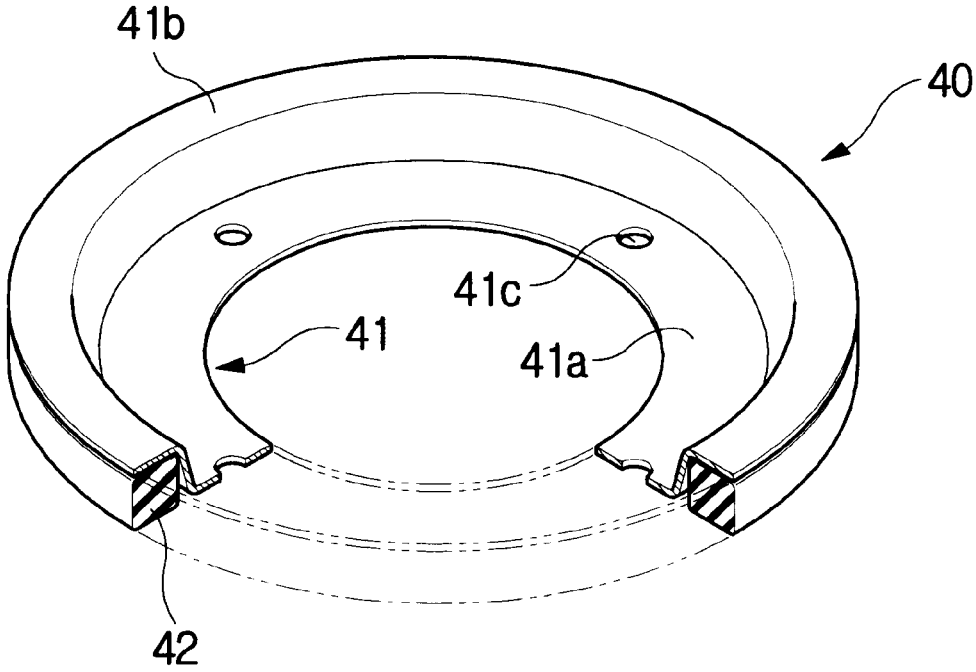
FIG. 5 is a partially broken perspective view of the anti-collision device as shown in FIG. 3 included in the linear compressor.

As shown in FIGS. 3 to 5, the stopper 41 of the anti-collision device 40 is a type of dish-shaped spring, which includes a mounting part 41*a* and an elastic support part 41*b*. The mounting part 41*a* has a ring-shaped appearance capable of covering the cylinder 32, and is mounted to the upper surface of the cylinder block 31. The elastic support part 41*b* integrally extends from an edge of the mounting part 41*a* while being inclined upward and outward at an angle of inclination such that the elastic support part 41*b* is spaced apart from the upper surface of the cylinder block 31 by a predetermined gap. The end of the movable member 21 collides against the elastic support part 41*b* of the stopper 41 just before the piston 34 moves past the upper dead center position of the piston 34. The stopper 41 may be produced using a rigid material, such as high strength steel, which effectively and successfully resists collision impact, but is only minutely and elastically deformed even when the end of the movable member 21 collides against the stopper 41. In addition, the distance "Y1" between the end of the movable member 21 and the elastic support part 41*b* of the stopper 41 when the piston 34 is positioned at the upper dead center position may be set, such that the distance "Y1" is slightly shorter than the minimum gap distance "X1" (typically maintained in a range between about 100 $\mu$m to about 200 $\mu$m) between the cylinder head 33 and an end of the piston 34 in the case where the piston 34 is positioned at the upper dead center position, thus "X1" is less than "Y1".

The stopper 41 along with the inner stator 23 is fixed to the upper surface of the cylinder block 31 using the mounting bolts 25. In order to receive the mounting bolts 25, a plurality of through holes 41*c* are regularly formed at the mounting part 41*a* of the stopper 41 at positions corresponding to the internally-threaded holes 26 formed at the cylindrical holder 23*a* of the inner stator 23. Therefore, when the mounting bolts 25 pass through the through holes 41*c* of the stopper 41 and are tightened into the internally-threaded holes 26 of the cylindrical holder 23*a* at the outside of the lower surface of the cylinder block 31 after the stopper 41 and the inner stator 23 are sequentially arranged on the upper surface of the cylinder block 31, the stopper 41 along with the inner stator 23 are firmly mounted to the upper surface of the cylinder block 31.

The damping member 42 is a ring-shaped body having a predetermined thickness, and is arranged at the gap between the elastic support part 41*b* of the stopper 41 and the upper surface of the cylinder block 31. The damping member 42 can be made of a shock absorbing material, such as rubber having elasticity, which is capable of attenuating a collision impact when the elastic support part 41*b* of the stopper 41 collides against the end of the movable member 21 to be deformed. The damping member 42 is bonded to the upper surface of the cylinder block 31 such that the damping member 42 is positioned under the elastic support part 41*b* of the stopper 41. In such a case, a gap "Y2" can be defined between the damping member 42 and the elastic support part 41*b* of the stopper 41. A gap "Y2" can be set to a range of about 20 $\mu$m to about 50 $\mu$m. Such a gap "Y2" allows the elastic support part 41*b* of the stopper 41 to contact with the damping member 42 while being elastically deformed when the piston 34 moves past a range within which the elastic support part 41*b* of the stopper 41 effectively limits the movement of the piston 34. The stopper 41 thus primarily and secondarily limits an abnormal movement of the piston 34.

The operational effect of the linear compressor according to an embodiment of the present invention will be described herein below.

When an alternating current AC is applied to the coil 22*b* of the outer stator 22, the coil 22*b* generates a magnetic flux. The magnetic flux of the coil 22*b* cooperates with the magnetic field of the magnet 21*a* mounted to the movable member 21, thus allowing the movable member 21 with the magnet 21*a* to linearly reciprocate in a vertical direction. The piston 34, operated in conjunction with the movable member 21, thus linearly reciprocates in the cylinder 32. In such a case, the resonant spring 24 of the plate spring type is vibrated at the same time as the linear reciprocating action of the piston 34, and so the reciprocating force of the piston 34 is enhanced.

When the piston 34 moves from the stop position of the piston 34 to the lower dead center position of the piston 34 during the reciprocating action, the suction valve 36 is opened to suck gas refrigerant from the suction chamber 33*a* of the cylinder head 33 into the cylinder 32. When the piston 34 moves to the upper dead center position of the piston 34, the suction valve 36 is closed, and the exhaust valve 37 is opened to discharge the compressed gas refrigerant from the cylinder 32 to the exhaust chamber 33*b*. The compressed gas refrigerant is, thereafter, fed to a unit outside the hermetic casing 10.

When the piston 34 performs a normal reciprocating action of the piston 34 in the cylinder 32, the distance "Y1" between the end of the movable member 21 and the stopper 41 of the anti-collision device 40 is maintained even though the piston 34 reaches the upper dead center position of piston 34. In such a case, the end of the piston 34 approaches the cylinder head 33 while maintaining the minimum gap distance "X1" between the cylinder head 33 and the end of the piston 34. Due to the minimum gap distance "X1", the end of the piston 34 does not collide against the suction valve 36 of the cylinder head 33 when the piston 34 moves to the upper dead center position of the piston 34.

During the linear reciprocating action of the piston 34 in the cylinder 32, the piston 34 may move past the upper dead center position of the piston 34 and approach too closely to the cylinder head 33 due to unexpected internal or external causes, such as unexpected rapid variation in an applied voltage or unexpected rapid variation in a pressure of fluid.

Figure 6:
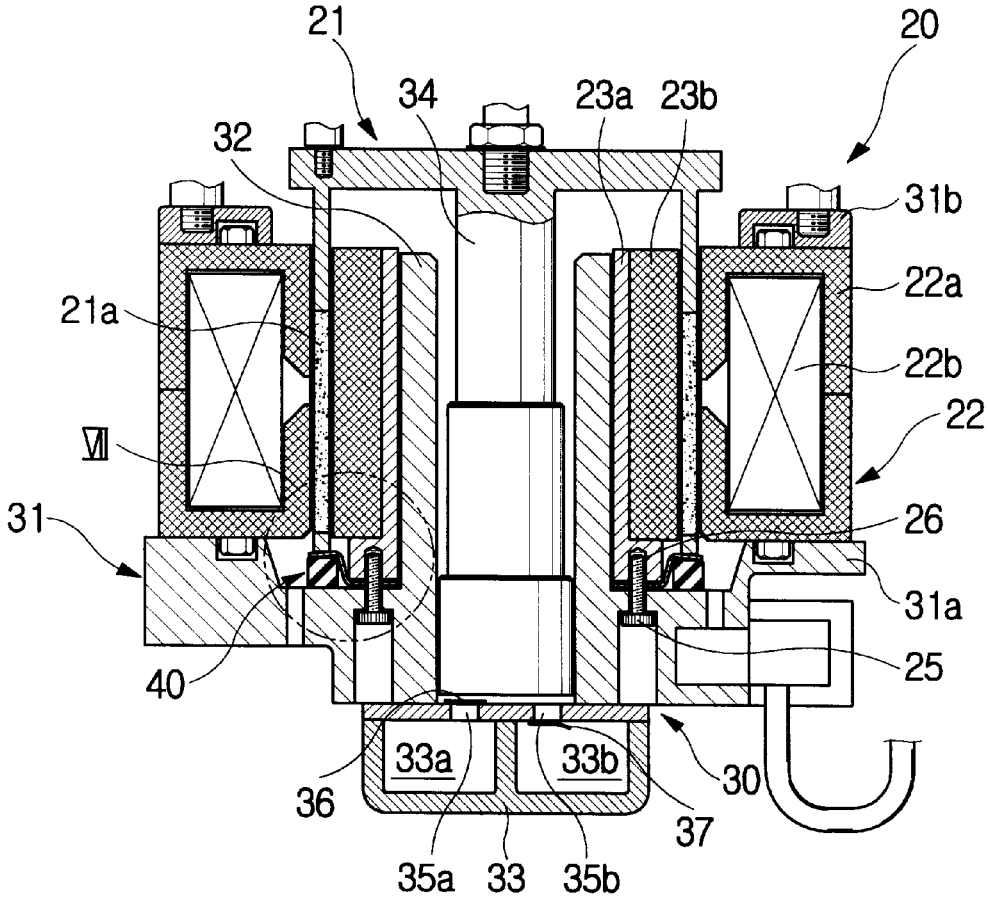
Figure 7:
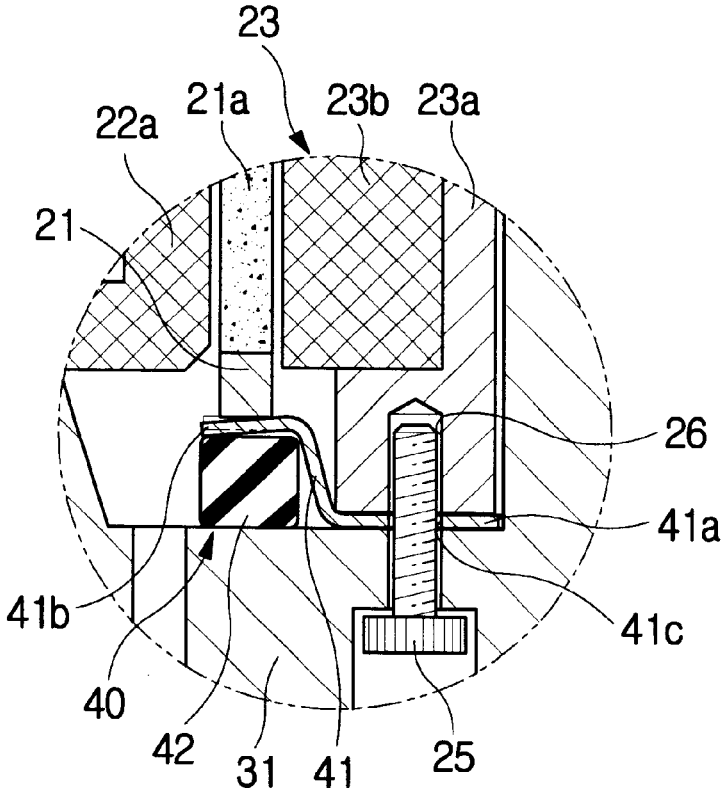

In such a case, the end of the movable member 21 contacts with the elastic support part 41*b* of the stopper 41 just before the piston 34 moves past the upper dead center position of the piston 34 and collides with the suction valve 36 of the cylinder head 33 as shown in FIGS. 6 and 7. Therefore, the piston 34 is effectively prevented from moving further toward the cylinder head 33.

Thus, preventing the piston 34 from colliding against the suction valve 36 of the cylinder head 33 is possible, and therefore, the piston 34 can smoothly perform the linear reciprocating action of the piston 34 in the cylinder 32. When the end of the movable member 21 collides against the elastic support member 41*b* of the stopper 41, the elastic support member 41*b* of the stopper 41 absorbs the collision impact by elasticity of the elastic support member 41*b* of the stopper 41 while being minutely and elastically deformed such that the deformation of the support member 41*b* does not affect the minimum gap distance "X1" of the piston 34. Further, the elastic support member 41*b* of the stopper 41 has a ring-shaped appearance capable of effectively and widely distributing collision impact energy in a body of the stopper 41, and so the support member 41*b* is unlikely to generate operational noise during an operation of the anti-collision device 40.

Figure 8:
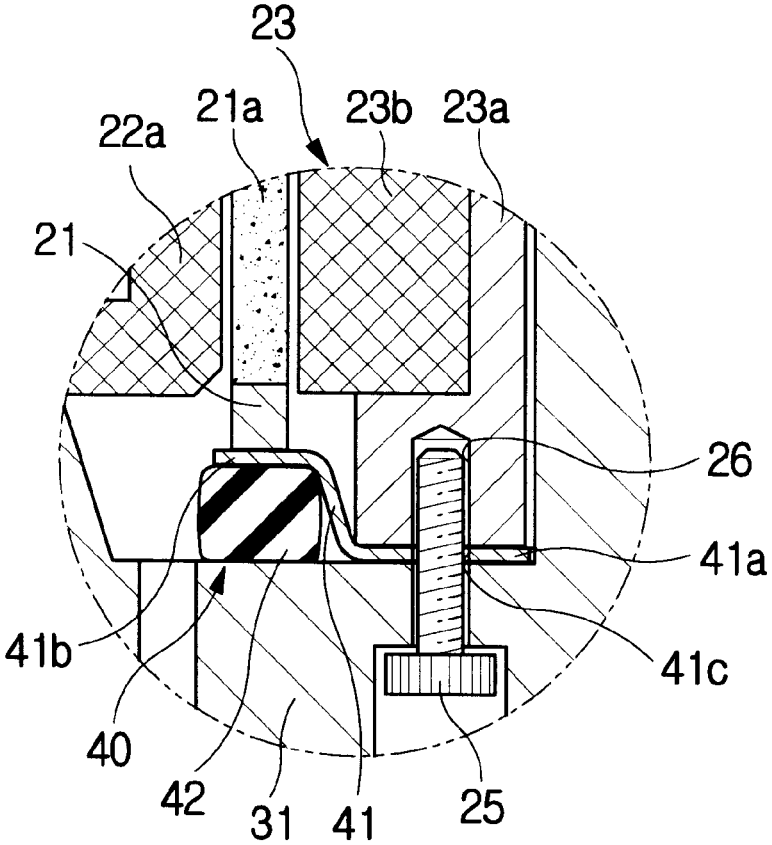
FIG. 8 is a sectional view of the portion VII of FIG. 6, showing a second operating state of the anti-collision device of the embodiment of the present invention.

The anti-collision device 40 effectively prevents the piston 34 from colliding against the cylinder head 33 even when the piston 34 excessively approaches the cylinder head 33 after moving past the upper dead center position of the piston 34. That is, as shown in FIG. 8, when the piston 34 approaches the cylinder head 33 after moving past the upper dead center position of the piston 34, the end of the movable member 21 primarily collides against the elastic support part 41*b* of the stopper 41. When the piston 34 further approaches the cylinder head 33 after the end of the movable member 21 primarily collides against the elastic support part 41*b* of the stopper 41, the elastic support part 41*b* is elastically deformed downward to secondarily collide against the damping member 42.

When the elastic support part 41*b* of the stopper 41 secondarily collides against the damping member 42 as described above, the piston 34 is prevented from moving toward the cylinder head 33. The end of the piston 34 is thus prevented from directly contacting with the cylinder head 33. In such a case, since the elastic support part 41*b* of the stopper 41 collides against the elastic damping member 42, both the support part 41*b* and the damping member 42 effectively absorb the collision impact energy, and are unlikely to generate operational noise.

The excessive movement of the piston 34 past the upper dead center position of the piston 34 is limited primarily by the stopper 41, and secondarily by the damping member 42. Thus, the anti-collision device 40 can prevent within a normal operating range of the linear compressor, the end of the piston 34 from coming into direct collision against the cylinder head 33.

Figure 9:
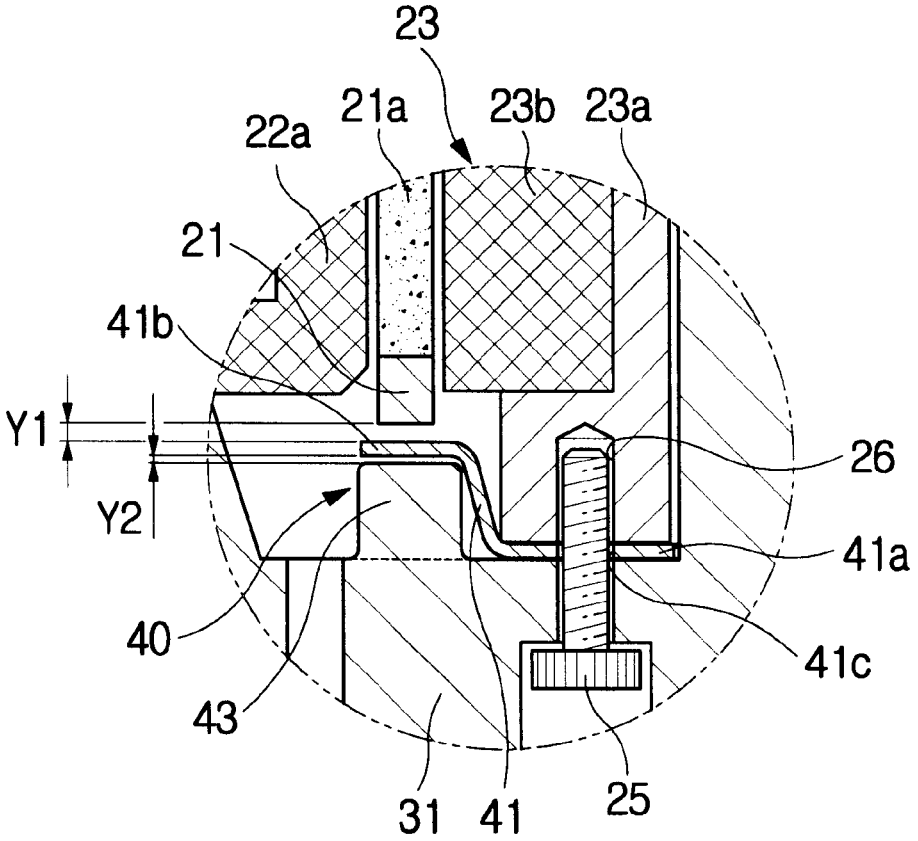
FIG. 9 is a sectional view of an anti-collision device in accordance with a second embodiment of the present invention.

The anti-collision device 40 has the damping member 42, which is separately produced from the cylinder block 33 and installed on the upper surface of the cylinder block 33 at a position under the elastic support part 41*b* of the stopper 41. However, a ring-shaped protrusion 43 may be integrally formed on the upper surface of the cylinder block 33 such that the protrusion 43 is positioned under the elastic support part 41*b* of the stopper 41 while leaving a gap distance "Y2" between the upper surface of the ring-shaped protrusion 43 and the elastic support part 41*b* of the stopper 41 as shown in FIG. 9. The ring-shaped protrusion 43 of FIG. 9 produces the same operational effect as the damping member 42 without affecting the functioning of the present invention.

In the embodiments of the present invention, the anti-collision device is installed in the linear compressors having vertical pistons. However, the anti-collision device of the present invention may be used with a linear compressor having a horizontal piston without affecting the functioning of the present invention.

As described above, the present invention provides a linear compressor with an anti-collision device. The anti-collision device prevents the piston of the compressor from being brought into collision with the cylinder head or the suction valve even when the piston moves past the upper dead center position of the piston during an operation of the compressor. Therefore, the piston and the cylinder head having the suction valve can be prevented from breaking. The linear compressor having the anti-collision device of the present invention almost completely prevents a collision of the piston with the suction valve or the cylinder head during an operation, thus minimizing the gap between the piston and the cylinder head when the piston reaches the upper dead center position of the piston. Therefore, the linear compressor of this invention has improved operational performance and improved volumetric efficiency without enlarging a size of the linear compressor.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed:

1. A linear compressor, comprising:

a cylinder block having a first surface with a cylinder receiving a piston while allowing the piston to linearly reciprocate in said cylinder;

a cylinder head assembled with a second surface of the cylinder block and used to guide inlet and outlet refrigerant;

a movable member connected to the piston and provided with a magnet arranged around the cylinder;

a drive unit reciprocating both the piston and the movable member; and an anti-collision device set between the first surface of the cylinder block and an end of the movable member, and used to prevent the piston from moving past an upper dead center position, wherein the anti-collision device comprises an elastic part supported by the first surface of the cylinder block and a portion of the elastic part is spaced apart from the first surface of the cylinder block with a gap therebetween such that the portion of the elastic part, which is spaced apart from the first surface of the cylinder block, collides with the end of the movable member just before the piston moves past the upper dead end position to prevent the piston from colliding with the cylinder head.

2. A linear compressor, comprising:

a cylinder block having a first surface with a cylinder receiving a piston while allowing the piston to linearly reciprocate in said cylinder;

a cylinder head assembled with a second surface of the cylinder block and used to guide inlet and outlet refrigerant;

a movable member connected to the piston and provided with a magnet arranged around the cylinder;

a drive unit reciprocating both the piston and the movable member; and an anti-collision device set between the first surface of the cylinder block and an end of the movable member, and used to prevent the piston from moving past an upper dead center position to prevent the piston from colliding with the cylinder head, wherein said anti-collision device comprises a stopper including an elastic support part attached to the first surface of said cylinder block while being inclined at an angle of inclination with respect to the first surface of the cylinder block such that the elastic support part is spaced apart from the first surface of the cylinder block at a predetermined gap, said elastic support part colliding with the end of the movable member just before the piston moves past the upper dead end position, thereby avoiding a collision between the piston and the cylinder head.

3. A linear compressor, comprising:

a cylinder block having a first surface with a cylinder receiving a piston while allowing the piston to linearly reciprocate in said cylinder;

a cylinder head assembled with a second surface of the cylinder block and used to guide inlet and outlet refrigerant;

a movable member connected to the piston and provided with a magnet arranged around the cylinder;

a drive unit reciprocating both the piston and the movable member; and an anti-collision device set between the first surface of the cylinder block and an end of the movable member, and used to prevent the piston from moving past an upper dead center position to prevent the piston from colliding with the cylinder head, wherein said anti-collision device comprises a stopper including a mounting part having a ring shape, and mounted to the first surface of said cylinder block; and an elastic support part integrally extending from an edge of said mounting part while being inclined at an angle of inclination with respect to the first surface of the cylinder block such that the elastic support part is spaced apart from the first surface of the cylinder block at a predetermined gap, said elastic support part colliding with the end of the movable member just before the piston moves past the upper dead end position of the piston, thereby avoiding a collision between the piston and the cylinder head.

4. The linear compressor according to claim 3, wherein said drive unit comprises a stator mounted to an upper surface of said cylinder block using a mounting bolt such that the stator is arranged around the cylinder; and said mounting part of the stopper is arranged between the first surface of the cylinder block and said stator of the drive unit, and is mounted along with the stator to the first surface of the cylinder block using said mounting bolt.

5. The linear compressor according to claim 3, wherein said anti-collision device further comprises:

a damping member provided at the predetermined gap between the elastic support part of the stopper and the first surface of the cylinder block.

6. The linear compressor according to claim 5, wherein a first surface of the damping member is connected to the first surface of the cylinder block, wherein the predetermined gap is defined by a space between a second surface of the dampening member and the elastic support part such that the elastic support part is elastically deformed when the elastic support part contacts the damping member by the piston moving past the upper dead end position.

7. The linear compressor according to claim 6, wherein the predetermined gap is set to be in a range of about 20 μm to 50 μm.

8. The linear compressor according to claim 5, wherein said damping member is made of ring-shaped rubber having a predetermined thickness, and attached to the first surface of said cylinder block.

9. The linear compressor according to claim 3, wherein said anti-collision device further comprises:

a protrusion integrally formed on the first surface of the cylinder block such that said protrusion is positioned under the elastic support part of the stopper while leaving a gap between a surface of the protrusion and the elastic support part of the stopper.

10. A linear compressor with a cylinder block, a cylinder connected to a first surface of the cylinder block and receiving a piston while allowing the piston to linearly reciprocate in the cylinder, a cylinder head assembled with a second surface of the cylinder block and used to guide inlet and outlet refrigerant, a movable member connected to the piston and arranged around the cylinder; and a drive unit reciprocating both the piston and the movable member, the linear compressor comprising:

an anti-collision device set between the first surface of the cylinder block and an end of the movable member and used to prevent the piston from moving past an upper dead center position to prevent the piston from colliding with the cylinder head, wherein the anti-collision device includes a first anti-collision unit, which elastically deforms during a collision with the movable member, when the piston moves past the upper dead end position and a second anti-collision unit, different from the first anti-collision unit, which damps the movement of the movable member after the first anti-collision unit is displaced a predetermined amount by the collision with the moveable member, the first and second anti-collision units being provided on one side of the moving member in a movement path thereof.

11. A linear compressor with a cylinder block, a cylinder connected to a first surface of the cylinder block and receiving a piston while allowing the piston to linearly reciprocate in the cylinder, a cylinder head assembled with a second surface of the cylinder block and used to guide inlet and outlet refrigerant, a movable member connected to the piston and arranged around the cylinder; and a drive unit reciprocating both the piston and the movable member, the linear compressor comprising:

an anti-collision device set between the first surface of the cylinder block and an end of the movable member and used to prevent the piston from moving past an upper dead center position to prevent the piston from colliding with the cylinder head, wherein the anti-collision device includes a first anti-collision unit, which elastically deforms during a collision with the movable member, when the piston moves past the upper dead end position and a second anti-collision unit, different from the first anti-collision unit, which damps the movement of the movable member after the first anti-collision unit is displaced a predetermined amount by the collision with the moveable member, wherein the first anti-collision unit comprises:

a stopper positioned between the cylinder block and the movable member and including an elastic support part extending at an angle of inclination with respect to the first surface of the cylinder block such that the elastic support part is spaced apart from the first surface of the cylinder block at a predetermined gap, said elastic support part colliding with the end of the movable member just before the piston moves past the upper dead end position.

12. The linear compressor according to claim 11, wherein the elastic support part is shaped in a form of a ring to distribute impact energy of collision between the movable member and elastic support part such that noise from the collision is reduced.

13. The linear compressor according to claim 11, wherein the stopper is made of a rigid material.

14. The linear compressor according to claim 11, wherein the stopper is made of high strength steel.

15. The linear compressor according to claim 11, wherein the predetermined gap between the elastic support part and the first surface of the cylinder block corresponds with a minimum gap between the cylinder head and the upper dead end position of the piston.

16. The linear compressor according to claim 11, wherein the stopper further comprises:

a damping member provided at the predetermined gap between the elastic support part of the stopper and the first surface of the cylinder block, a first surface of the damping member is connected to the first surface of the cylinder block, wherein the predetermined gap is defined by a space between a second surface of the dampening member and the elastic support part such that the elastic support part is elastically deformed when the elastic support part contacts the damping member by the piston moving past the upper dead end position.

17. The linear compressor according to claim 16, wherein the predetermined gap is in a range of about 20 μm to 50 μm.

18. A linear compressor with a cylinder block, a cylinder connected to a first surface of the cylinder block and receiving a piston while allowing the piston to linearly reciprocate in the cylinder, a cylinder head assembled with a second surface of the cylinder block and used to guide inlet and outlet refrigerant, a movable member connected to the piston and arranged around the cylinder; and a drive unit reciprocating both the piston and the movable member, the linear compressor comprising:

a noiseless anti-collision device set between the first surface of the cylinder block and an end of the movable member and used to prevent both the piston from moving past an upper dead center position, thereby avoiding a collision between the piston and the cylinder head, and the generation of noise corresponding to a collision of the moving member with an elastic support part, the elastic part supported by the first surface of the cylinder block and a portion of the elastic part being spaced apart from the first surface of the of the cylinder block with a gap therebetween such that the portion of the elastic part, which is spaced apart from the first surface of the cylinder block, collides with the end of the movable member just before the piston moves past the upper dead end position.

19. A method of preventing collision between a piston and cylinder head of a linear compressor by connecting a moveable member to the piston and restricting a movement of the movable member, comprising:

reciprocating the piston in a cylinder and the moveable member connected to the piston by a drive unit of the linear compressor;

elastically deforming an elastic support part, which is provided in a path of movement of the movable member, when the moveable member collides with the elastic support part just prior to the piston reaching an upper dead end position of the piston, as a primary anti-collision operation; and after said elastic deformation, if the movement of the moveable member exceeds a predetermined amount, damping the movement of the movable member by sequentially providing a damping member after the elastic support part with respect to the movement path of the moveable member, the dampening member to absorbs impact energy of the moveable member, as a secondary anti-collision operation.

* * * * *